US007695324B2

(12) United States Patent
Diekmann

(10) Patent No.: US 7,695,324 B2
(45) Date of Patent: Apr. 13, 2010

(54) STACKED TERMINAL BLOCK ARRANGEMENT WITH CONNECTOR MEANS

(75) Inventor: Joerg Diekmann, Oerlinghausen (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/288,539

(22) Filed: Oct. 20, 2008

(65) Prior Publication Data

US 2009/0111334 A1 Apr. 30, 2009

(30) Foreign Application Priority Data

Oct. 23, 2007 (DE) ..... 20 2007 014 863 U

(51) Int. Cl.
*H01R 9/22* (2006.01)

(52) U.S. Cl. ..... 439/721

(58) Field of Classification Search ..... 439/713–721, 439/835

See application file for complete search history.

(56) References Cited

U.S. PATENT DOCUMENTS 5,853,304 A * 12/1998 Landreau et al. ..... 439/721
6,146,213 A * 11/2000 Yoon ..... 439/716
6,425,770 B1 * 7/2002 Lostoski et al. ..... 439/716
6,485,336 B1 11/2002 Zebermann
7,232,324 B2 6/2007 Oesterhaus

* cited by examiner

*Primary Examiner*—Briggitte R Hammond
(74) *Attorney, Agent, or Firm*—Lawrence E. Laubscher, Sr.; Lawrence E Laubscher, Jr.

(57) ABSTRACT

A connector arrangement connects the contacts of a stack of terminal blocks, including a first conductive bridge extending longitudinally of a given terminal block for selectively connecting together the contacts thereof, and a second laterally-extending conductive bridge for connecting together corresponding contacts of various selected terminal blocks of the stack. The terminal blocks are mounted in parallel vertical orientation on an orthogonally arranged horizontal mounting rail. Vertical branch lines extend upwardly from a plurality of horizontal vertically-spaced bus bar members contained in each of the terminal blocks, and intermediate branch lines connected with the upper ends of the vertical branch lines contain offset tiered first and second contact areas. Resilient fingers on the longitudinal and lateral conductive bridges extend into and electrically engage openings contained in the first and second contact areas, respectively.

10 Claims, 4 Drawing Sheets

STACKED TERMINAL BLOCK ARRANGEMENT WITH CONNECTOR MEANS

BACKGROUND OF THE INVENTION

1. Field of the Invention

A connector arrangement connects the contacts of a stack of terminal blocks, including first conductive bridge means extending longitudinally above a given terminal block for selectively connecting together the contacts thereof, and second laterally-extending conductive bridge means connecting together corresponding contacts of various selected terminal blocks of the stack. Resilient fingers on the longitudinal and lateral conductive bridges respectively engage openings contained in offset tiered first and second contact areas contained in branch conductors that are connected with bus bars contained in the terminal blocks, respectively.

2. Description of Related Art

It is known in the prior art to provide means for connecting together the electrical contacts of a plurality of terminal blocks mounted in stacked parallel arrangement on a mounting rail. Each of the terminal blocks contains a plurality of bus bars that connect various electrical contacts of the terminal block. First external connector means connect together selected bus bars of a given terminal block, and second external connector means connect together a bus bar of one terminal block with corresponding bus bars of other selected terminal blocks of the stack.

By attaching or, respectively, inserting the connectors into the plug-in positions provided for them it will be possible to connect bus bars of two or more terminal blocks in the lateral direction in conductive fashion in order to realize a lateral distribution of one or several potentials in the transverse direction.

In this context it has been known to provide the lateral connectors with plugs separable at predetermined breaking points so that it will be possible to connect only certain of the terminal blocks with each other in conductive fashion. This generic arrangement per se has stood the test of time.

However, it is desirable to make possible the distribution of electrical power within the terminal block arrangement more varied in a simple manner to provide additional possibilities for a distribution of power as compared to the state of the art.

According to it, the generic arrangement is provided with additional plug-in positions and/or a design of the plug-in positions to accommodate at least one additional connector or several additional pluggable connectors for a distribution of one or several potentials within the respective terminal blocks.

The invention makes it possible to distribute potentials not only in the lateral direction between terminal blocks, but also to connect bus bars within each terminal block for distribution in a simple manner, quasi arbitrarily, so that the possibilities for a distribution of potential within the terminal block arrangement are clearly increased or, respectively, expanded. Within the framework of the present invention, lateral distribution is to be understood, on the one hand, as the lateral distribution in transverse direction across several terminal blocks, and, on the other hand, as a distribution within a given terminal block, thus in particular also a "vertical distribution" in the terminal block. Preferably, at least one of the connectors will therefore be designed as a lateral connector and at least one connector as a vertical connector.

SUMMARY OF THE INVENTION

Accordingly, a primary object of the invention is to provide a connector arrangement for connecting the contacts of a stack of terminal blocks, including a first conductive bridge extending longitudinally of a given terminal block for selectively connecting together the contacts thereof, and a second laterally-extending conductive bridge for connecting together corresponding contacts of various selected terminal blocks of the stack.

According to a more specific object of the invention, resilient fingers on the longitudinal and lateral conductive bridges respectively engage openings contained in offset tiered first and second contact areas contained in intermediate branch conductors that are connected with respective bus bars contained in the terminal blocks. In one embodiment, the intermediate branch conductors leading to the respective bus bars of a terminal block are carried by that terminal block. In a second embodiment, the intermediate branch conductors are carried by a separate connector attachment block that is attached to the stack of rail-mounted terminal blocks.

According to a more specific object, of the invention, the connections of the resilient fingers to the conductive bridges are frangible, thereby to permit the user to select the various bus bars and contacts of the stack that are to be connected together.

According to a further embodiment, the vertical branch lines from the bus bars of each terminal block terminate in pin contacts that are adapted for engagement with the female resilient clip contacts of a first plug connector that serves as the longitudinal conductive bridge. In this embodiment, the lateral conductive bridge between the terminal blocks of a stack is defined by a lateral conductor that is connected between one end of a given bus bar and the corresponding ends of bus bars of selected other terminal blocks of the stack. The other ends of the bus bars of each terminal block terminate in pin contacts that are arranged for engagement by the female clip contacts of an associated second plug connector.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
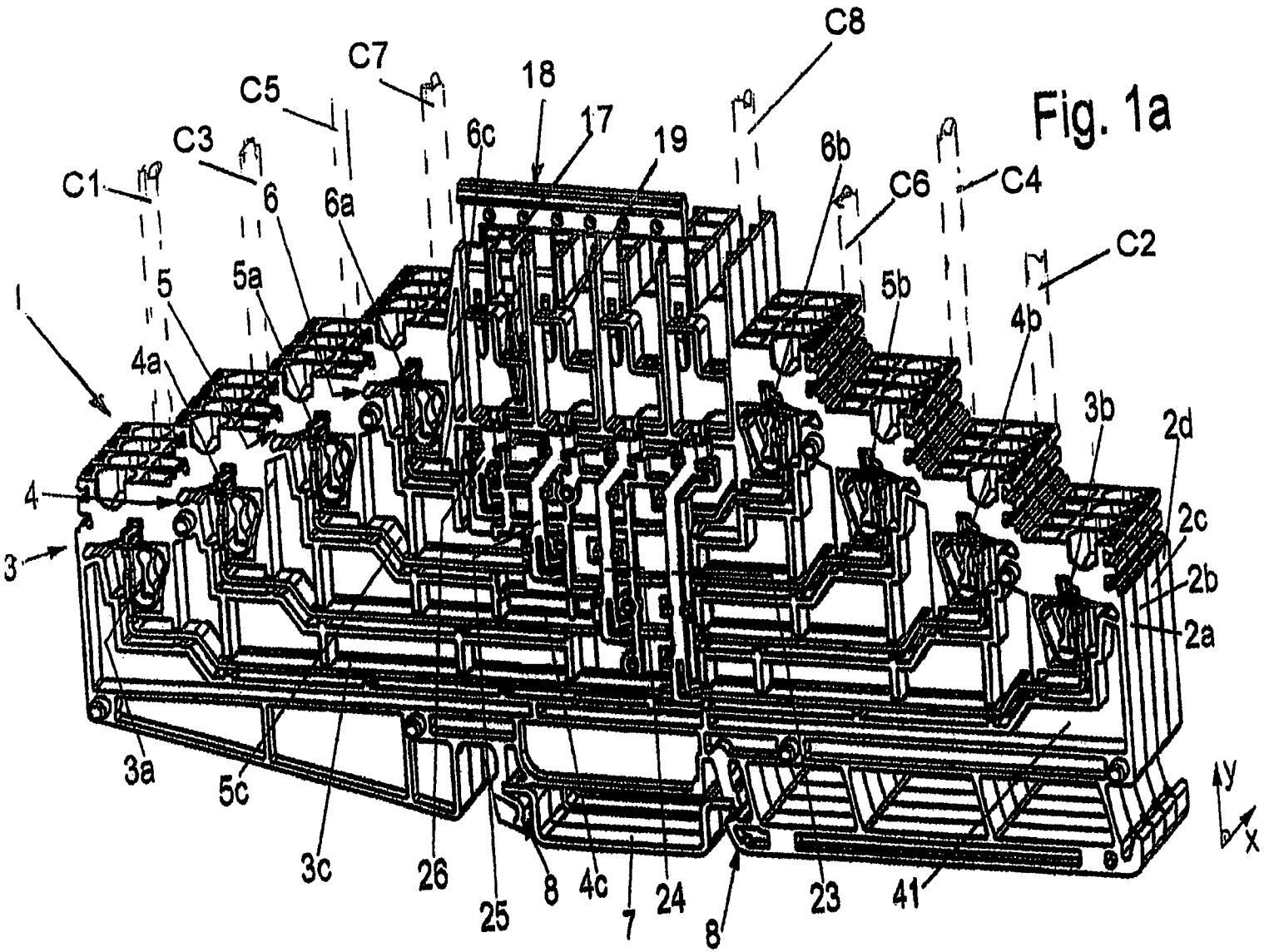
FIG. 1*a* is a perspective view of the preferred embodiment of the invention.
Figure 1B:
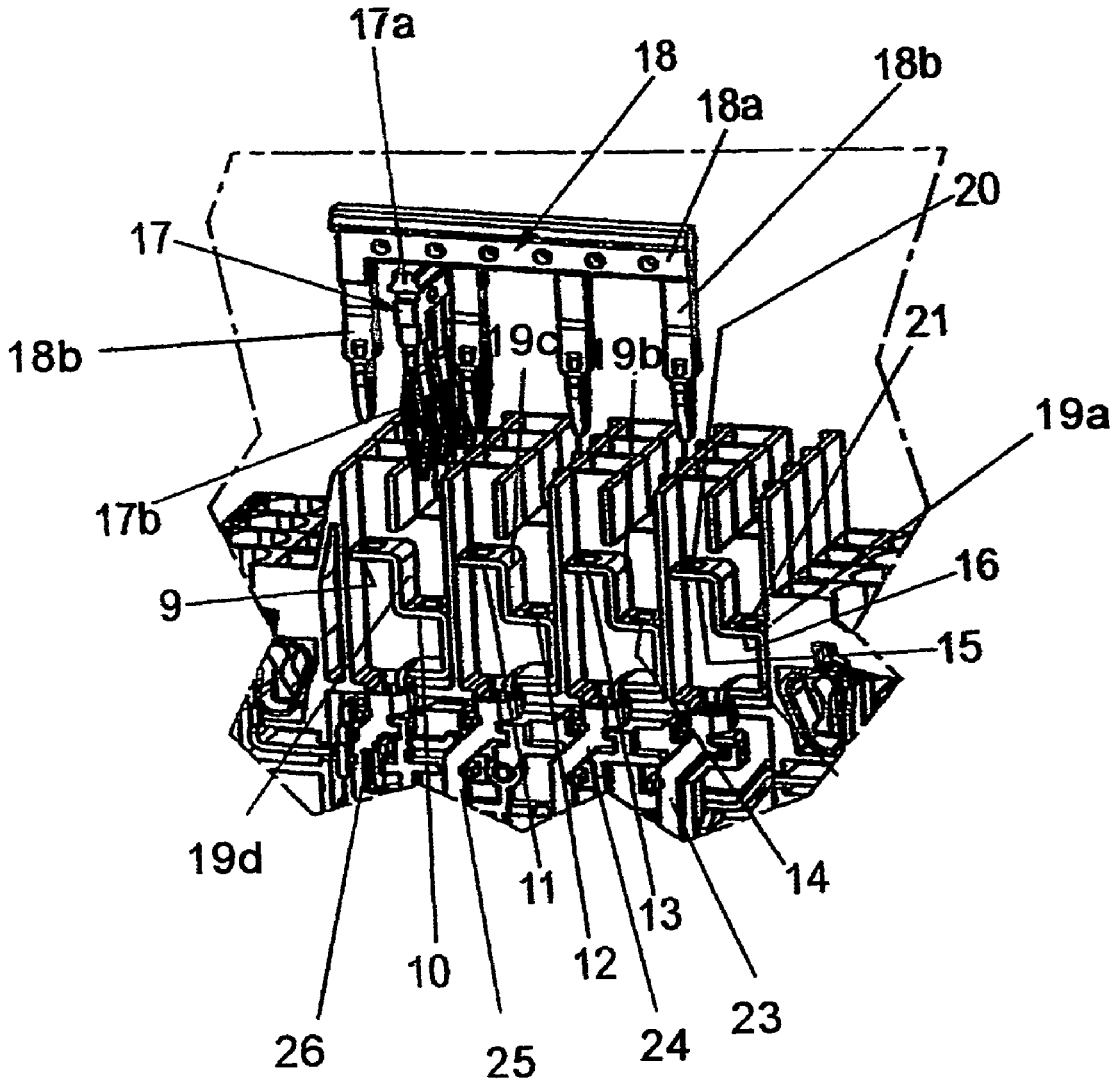
FIG. 1*b* is a detailed perspective view of the conductive longitudinal and lateral bridge means of FIG. 1*a;*

Referring first more particularly to FIGS. 1*a* and 1*b*, the terminal block connector arrangement 1 includes a plurality of parallel terminal blocks 2*a*, 2*b*, 2*c*, and 2*d* having bodies 41 formed of an electrically insulating synthetic plastic material and mounted in stacked relation on a horizontal mounting rail 7 by means of integral mounting feet 8, as is known in the art. Each of the terminal blocks contains a plurality of horizontal vertically-spaced bus bars 3*c*, 4*c*, 5*c* and 6*c* the ends of which are connected with resilient-clip-type contacts 3*a*, 3*b*, 4*a*, 4*b*, 5*a*, 5*b*, 6*a*, 6*b*, respectively, that are adapted for connection with the bare ends of conductors C1-C8 inserted downwardly via access openings formed in the top of the terminal block The bus bars are electrically connected with the lower ends of vertical branch lines 23-26 the upper ends of which are connected with vertical intermediate branch lines 19*a*-19*d*, respectively. As best shown in FIG. 1*b*, in accordance with a characterizing feature of the present invention, the upper ends of the intermediate branch lines have stepped tiered upper (9, 11, 13, 15) and lower (10, 12, 14, 16) horizontal portions that contain first and second contact openings 20 and 21, respectively. Arranged above the terminal block stack are bridge connector means including a longitudinal conductive bridge member 18 having a horizontal portion 18*a* that extends parallel with a given terminal block (terminal block 2*d*, for example), and a plurality of downwardly extending resilient contact fingers 18*b* that are adapted for insertion in electrical engagement within the first openings 20 contained in the upper contact portions 9, 11, 13, and 15, respectively. Rigidly connected with the longitudinal bridge 18 is a lateral bridge 17 having a horizontal portion 17*a*, and a plurality of downwardly extending resilient fingers 17*b* that are adapted for insertion in electrical engagement within the second openings 21 contained in the corresponding lower step portions (10, for example) of a selected number of the terminal blocks (for example, all of the terminal blocks 2*a*-2*d*).

According to an important feature of the invention, each of the resilient fingers 17*b* and 18*b* is connected with its associated horizontal bridge portion 17*a* and 18*a* by a frangible connection, whereby upon simple breaking off of given resilient fingers, the user may select the specific bus bars and contacts of the stack of terminal blocks that are to be connected together by the conductive bridge means. In this manner, a so-called matrix of connections between the contacts may be achieved as desired.

It is apparent that the invention is suitable for use with terminal blocks having various types of electrical contacts, such as contacts including tension springs, or compression springs, tulip-type resilient contacts, clip-on contacts or the like.

The tiered design of the current rails 19 to accommodate the conductive bridges 17, 18 makes it easily possible to arrange in each case two of the connectors in quasi crosswise fashion on top of each other so that current rails or, respectively, potentials can be distributed in crosswise fashion within the terminal blocks in the lateral direction, on the one hand, and vertically to the lateral direction on the other hand.

The conductive bridges 17, 18 are preferably designed comb-shaped and in each case have a horizontal support area 17*a*, 18*a*, and preferably detachable resilient plug-in fingers 17*b*, 18*b* so that the most varied potential distributions can be realized by breaking away plug-n areas 17*b*.

For example, a maximum of four terminal blocks 2*a*, 2*b*, . . . can be connected with each other in the lateral direction by means of one connector 17 with four plug-in areas 17*b* in lateral direction. If now in each case one of the additional connectors 18 is arranged in each of the four in-line clips 2*a*, 2*b*, . . . that connects the current rails 3*c*, 4*c*, . . . with each other within the in-line clips 2*a*, 2*b*, 2*c*, 2*d*, a potential is connected to many—in this case sixteen—connections 3*a*, 3*b*, 4*a*, . . . in simple fashion. The number of connections is only an example. For each individual terminal block, up to eight connections 3*a*, 3*b*, . . . may be provided for with up to four connection planes 3-6.

Figure 2:
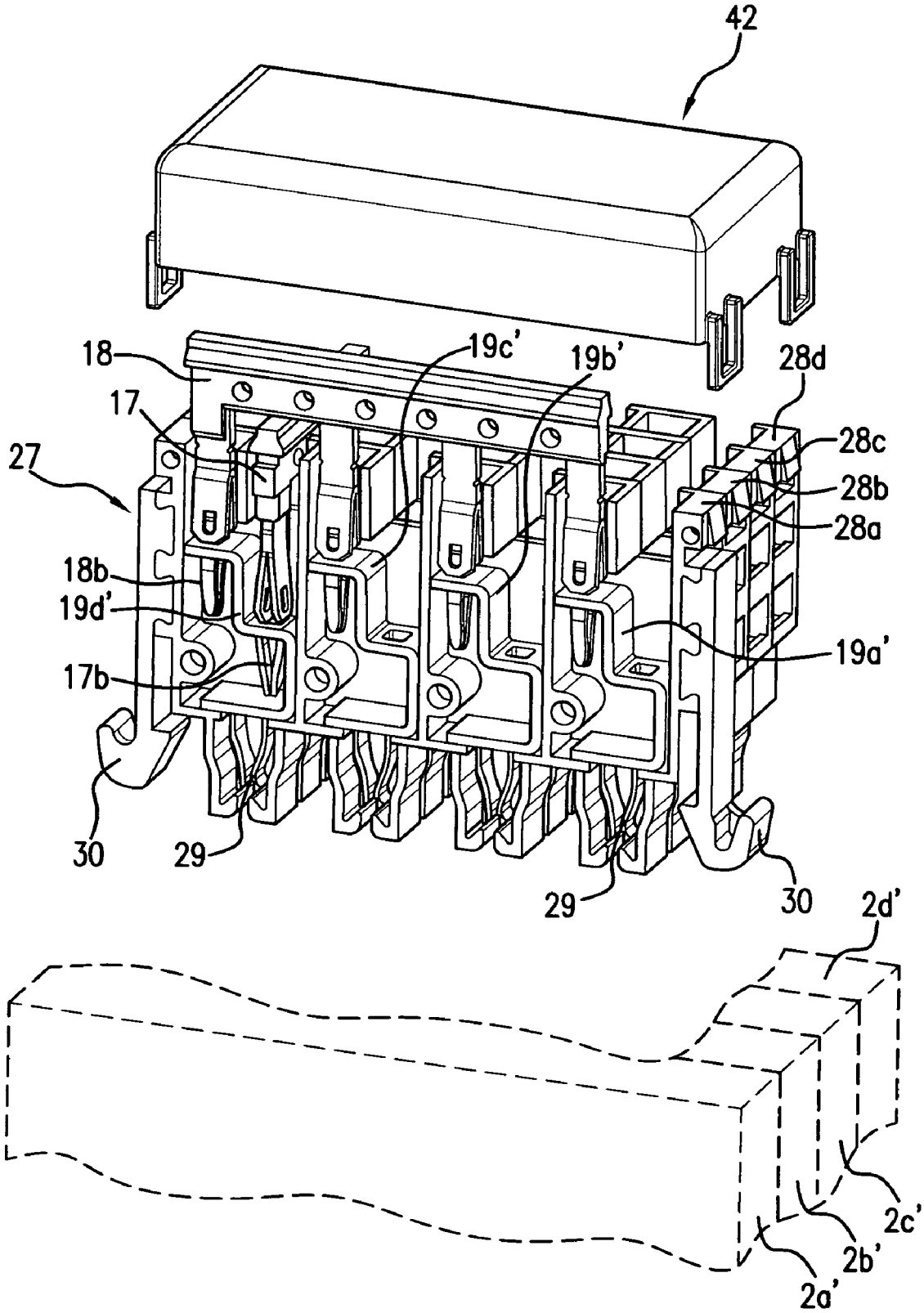
FIG. 2 is a perspective view of a second embodiment of the invention including a universal connecting block arrangement.

In the modification shown in FIG. 2, the intermediate branch lines 19*a*'-19*d*' leading to the respective bus bars of the terminal blocks of a stack may be mounted in a separate connector attachment block arrangement 27 that is attached to the stack by means of mounting feet 30. As before, the upper portions of the intermediate branch lines are connected together by the resilient contacts 18*b* that extend downwardly from the longitudinal conductive bridge 18 through the first openings 20, and the corresponding lower portions of a number of terminal blocks of the stack are connected together by the resilient fingers 17*b* that extend downwardly from the lateral conductive bridge 17. The lower ends of the intermediate branch lines are connected by resilient tulip-shaped female contacts 29 with corresponding pin contacts at the upper ends of the corresponding vertical branch lines of the associated terminal block.

Figure 3:
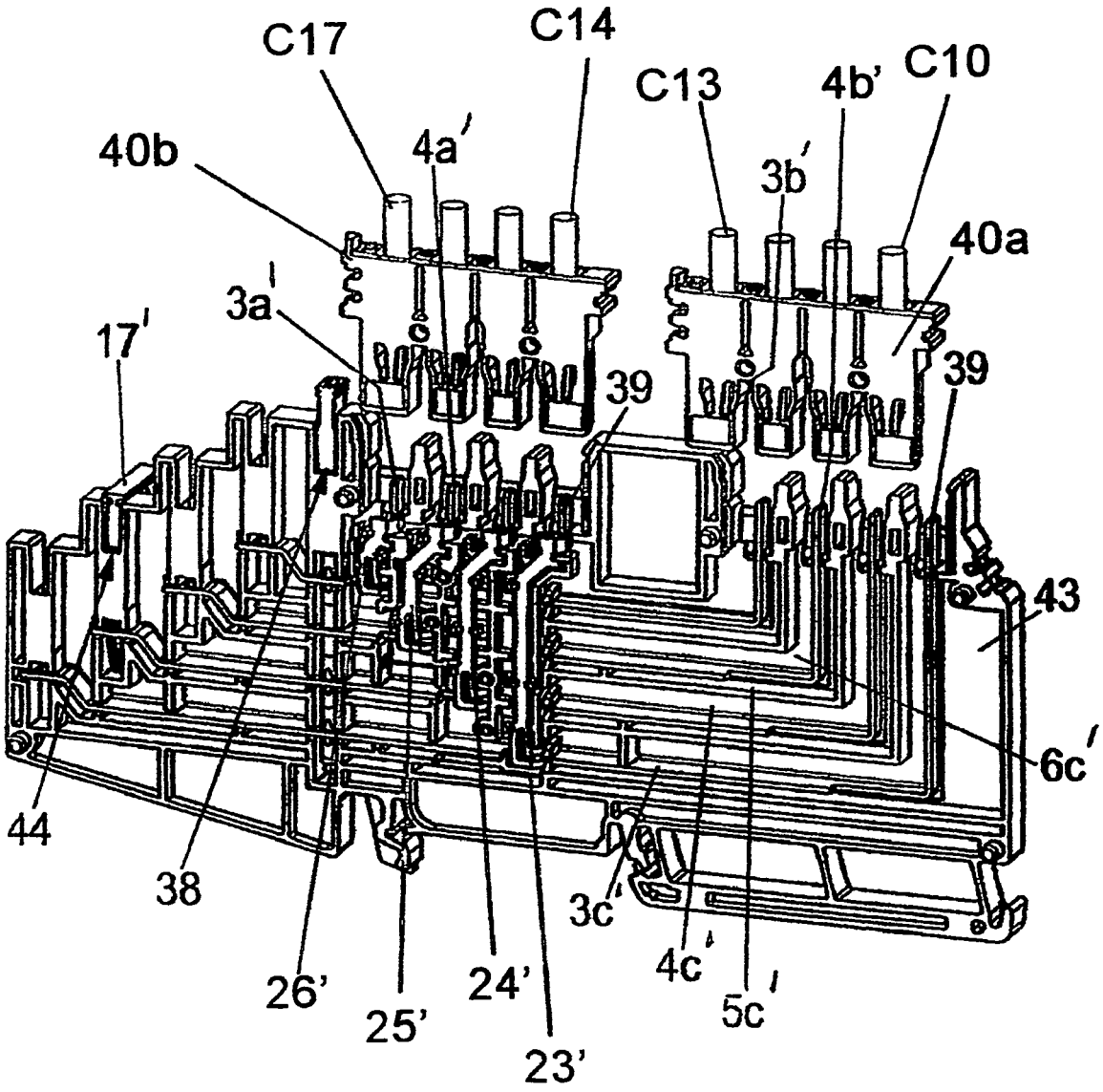
FIG. 3 is a perspective view of a third embodiment of the terminal block connector arrangement of the present invention.

In the embodiment of FIG. 3, the bus bars 3*c*', 4*c*', 5*c*' and 6*c*' contained within the terminal block body 43 are connected at one end with first pin contacts 39, and at the other ends with vertical conductors 44 containing openings 38. The vertical branch conductors 23', 24', 25', 26' are connected at their lower with the respective bus bars, and at their upper ends with second pins 39'. A first plug 40*a* connects the conductors C10-C13 with the bus bar ends, respectively, and a second plug 40*b* connects the bus bars with the conductors C14-C17, respectively. In practice, the second plug 40*b* serves as the longitudinal bridge for selecting the bus bars that are to be connected with the conductors associated with plug 40*a*. In this case, the lateral conductive bridge for connecting a bus bar (for example, the bus bar 4*c*') with a corresponding bus bar of an adjacent terminal block is provided by the lateral conductive bridge 17' seated at one end in an opening 38 contained in the vertical conductor 44.

While in accordance with the provisions of the Patent Statutes the preferred forms and embodiments of the invention have been illustrated and described, it will be apparent to those skilled in the art that changes may be made without deviating from the invention described above.

What is claimed is:

1. Connector apparatus for connecting together the contacts of a plurality of stacked terminal blocks, comprising:

(a) a stack of parallel terminal blocks (2*a*-2*d*)each including:

(1) a terminal block body (41) formed of electrically insulating synthetic plastic material;

(2) a plurality of electrical contacts (3*a*, 3*b*-6*a*, 6*b*) arranged in chambers contained in said body and adapted for connection with conductors (C1-C8) introduced into said body via access openings contained in said body, respectively; and (3) a plurality of bus bar means (3*c*-6*c*) connecting together various ones of said electrical contacts, respectively, each of said bus bar means including a plurality of parallel horizontal vertically-spaced bus bars (3*c*-6*c*) connected with said electrical contacts, respectively;

(b) first conductor means (18) connecting together selected bus bars of a given terminal block;

(c) second conductor means (17) connecting together selected bus bars of different terminal blocks of said terminal block stack;

(d) a horizontal mounting rail (7), said terminal blocks being vertically oriented and orthogonally arranged above said mounting rail, and (e) foot means (8) connecting said terminal blocks with said mounting rail;

(f) said first conductor means including:

(1) a plurality of vertical bus bar branch lines (23-26) having first ends connected with intermediate portions of said bus bars, respectively, said bus bar branch lines having second ends at the upper portion of the associated terminal block remote from said support rail;

(2) a plurality of intermediate branch lines (19) connected with the upper ends of said vertical branch lines, respectively, said intermediate branch lines each including first (9, 11, 13, 15) and second (10, 12, 14, 16) horizontal contact portions; and (3) a horizontal longitudinal conductive bridge member (18) arranged above and parallel with one of said terminal blocks, said longitudinal bridge member having horizontal body portion (18*a*), and a plurality of downwardly extending first finger portions (18*b*) electrically connected with said first contact portions of the intermediate connector branch lines of the associated terminal block, respectively.

2. Connector apparatus as defined in claim 1, wherein said electrical contacts include a plurality of pin contacts (3*a*'-6*b*') connected with first ends of said bus bar members, respectively, said lateral connecting means (17') being connected with the other ends of said bus bar members, respectively; and further including a plurality of vertical branch lines connecting intermediate portions of said bus bar members with said longitudinal connecting means (18'), respectively.

3. Connector apparatus as defined in claim 2, wherein said first conductor means includes a plug (18'), and pin and socket means (3*a*'-6*a*') connecting said plug with said bus bar vertical branch lines, respectively.

4. Connector apparatus as defined in claim 1, wherein said second conductor means includes:

(1) a horizontal lateral conductive bridge member (17) extending normal to and electrically connected with said longitudinal conductive bridge member;

(2) said lateral bridge member including a horizontal body portion (17*a*), and a plurality of downwardly extending second finger portions (17*b*) in electrical engagement with corresponding second contact portions (10, 12, 14, 16) of the intermediate branch lines of adjacent terminal blocks, respectively.

5. Connector apparatus as defined in claim 4, wherein at least some of said first and second finger portions are frangibly connected with the associated horizontal body portions, thereby to permit selective connection between the contacts of said terminal blocks.

6. Connector apparatus as defined in claim 4, wherein said downwardly extending first and second finger portions are resilient; and further wherein said intermediate branch line first and second contact portions contain first (20) and second (21) openings through which said first and second resilient finger portions extend, respectively.

7. Connector apparatus as defined in claim 4, wherein said intermediate branch line first (9, 11, 13, 15) and second (10, 12, 14, 16) contact portions are vertically tiered relative to each other.

8. Connector apparatus as defined in claim 7, and further including a connector attachment block (27) arranged above and removably connected with said stack of terminal blocks, said connector intermediate branch lines (19'), said longitudinal bridges (18) and said lateral bridges (17) being carried by said connector attachment block.

9. Connector apparatus as defined in claim 8, and further including a plurality of auxiliary contacts (29) connecting said intermediate branch lines with said bus bar vertical branch lines, respectively.

10. Connector apparatus as defined in claim 9, and further including a protective dust cover (42) removably mounted on said attachment block.

* * * * *